US009474309B2

(12) United States Patent
Yip

(10) Patent No.: US 9,474,309 B2
(45) Date of Patent: Oct. 25, 2016

(54) GARMENT PART WITH A FASTENING SYSTEM AND A METHOD OF MANUFACTURING THEREOF

(71) Applicant: Clover Mystique Co. Ltd., Kowloon, Hong Kong (HK)

(72) Inventor: Kwan Yin Yip, Hong Kong (HK)

(73) Assignee: Clover Mystique Co. Ltd., Kowloon (HK)

( * ) Notice: Subject to any disclaimer, the term of this patent is extended or adjusted under 35 U.S.C. 154(b) by 415 days.

(21) Appl. No.: 13/907,299

(22) Filed: May 31, 2013

(65) Prior Publication Data

US 2014/0357156 A1 Dec. 4, 2014

(51) Int. Cl.
*A41C 3/02* (2006.01)
*A41C 5/00* (2006.01)

(52) U.S. Cl.
CPC *A41C 3/02* (2013.01); *A41C 5/005* (2013.01)

(58) Field of Classification Search
CPC ..... A41C 3/02; A41C 3/12; A41F 1/006; A41F 1/008; A41F 1/04; A41B 1/10; A41B 1/18; A41B 2300/30; A41B 2300/32; A41B 2300/322; A41B 2300/324; A41B 2300/328; A41D 2300/30; A41D 2300/32; A41D 2300/322; A41D 2300/324; A41D 2300/326; A41D 2300/328
USPC ..... 2/98; 450/58, 1, 28, 33, 82, 9, 15, 17, 450/26; 24/618, 700, 694, 698
See application file for complete search history.

(56) References Cited

U.S. PATENT DOCUMENTS

| | | | | |
|---|---|---|---|---|
| 1,851,730 | A * | 3/1932 | Rutherford | 24/700 |
| 1,993,297 | A * | 3/1935 | Greenberg | A44B 19/38 2/128 |
| 2,148,269 | A * | 2/1939 | Koch | A41H 37/003 2/128 |
| 2,346,887 | A * | 4/1944 | Winkler | 24/618 |
| 2,765,471 | A * | 10/1956 | Cousins | 450/46 |
| 3,445,901 | A * | 5/1969 | Kamper | 24/618 |
| 3,837,049 | A * | 9/1974 | Corrado | 450/82 |
| 4,204,300 | A * | 5/1980 | Fildan | 24/578.1 |
| 6,149,496 | A | 11/2000 | Fildan | |
| 6,793,556 | B1 | 9/2004 | Fildan et al. | |
| 7,128,635 | B1 | 10/2006 | Liu | |
| 7,992,222 | B1 * | 8/2011 | Behrens | A41B 1/00 2/118 |
| 2007/0281584 | A1 | 12/2007 | Liu | |
| 2010/0124869 | A1 | 5/2010 | Liu | |
| 2011/0171881 | A1 | 7/2011 | Lau | |

FOREIGN PATENT DOCUMENTS

| | | | |
|---|---|---|---|
| CN | 1386448 | A | 12/2002 |
| CN | 2783779 | Y | 5/2006 |

OTHER PUBLICATIONS

International Search Report for PCT/CN2014/078004, dated Aug. 25, 2013, 5 pages.

* cited by examiner

*Primary Examiner* — Gloria Hale
(74) *Attorney, Agent, or Firm* — Ware, Fressola, Maguire & Barber LLP

(57) ABSTRACT

The invention relates to a bra part which includes a first garment portion having a female fastening member, and a second garment portion having a male fastening member. The female fastening member and the male fastening member are releasably engageable with each other to connect the first garment portion and the second garment portion, so that when the female fastening member and the male fastening member are engaged with each other, the female fastening member and the male fastening member are substantially fully encased within the part.

24 Claims, 11 Drawing Sheets

GARMENT PART WITH A FASTENING SYSTEM AND A METHOD OF MANUFACTURING THEREOF

FIELD OF THE INVENTION

The invention relates to a garment part with a fastening system. Particularly, the invention relates to a garment part with a fastening system which may be used in a garment, such as in a brassiere. The invention also relates to a method of manufacturing the garment part and a garment.

BACKGROUND OF THE INVENTION

Brassieres, or in a more common term 'bras', are undergarments worn by women for covering and supporting their breasts. Apart from the fundamental functions of covering and supporting, a bra also serves an important decorative purpose to the body of the wearer. Nowadays bras are made with a variety of designs, which allow them to become appealing fashion items instead of merely as part of clothing necessities.

A bra commonly includes a front portion for covering breasts of the wearer, a back portion for connecting two ends of the front portion over the back of the wearer in use, and usually shoulder straps for connecting the front portion and the back portion to better support the breasts. For a traditional rear fastening bra, a clasp is provided at the ends of the back portion so that, when being worn, the clasp is at the back of the wearer. The clasp usually includes one or more pairs of small hooks and eyes in the form of looped metal wires, or one or more pins and grooves configuration. However, it is known to a bra wearer that, when putting on a rear fastening bra, it could be difficult for the wearer to mate the hooks with the respective eyes, or the pins with the respective grooves, at the back in a blind operation with their arms behind their back. In addition, some wearers may also find that the traditional clasps in use may cause discomfort to their body, as the traditional clasps are usually exposed to and contact the skin in use, and therefore the wearers could feel the presence of the clasp which significantly affect the comfort as required of an intimate clothing. In some circumstances, the exposed clasps may even cause scratches or sensitivities to the skin of the wearers. To overcome or at least mitigate the disadvantages of the rear fastening bras, front closure bras have been developed to allow fastening of the clasp provided at the front of the wearer. However, the problem of the discomfort to the wearers by the traditional clasps remains in the front closure bras. In addition, the traditional hooks and eyes clasp or clasp of similar designs, when used in a front closure bra, are invariably visible at the front of the bra, and therefore may negatively affect the appearance of the bra in use, which works against the decorative purpose of the bra.

SUMMARY OF THE INVENTION

According to a first aspect of the present invention, there is provided a garment part including a first garment portion having a first fastening member, and a second garment portion having a second fastening member, wherein the first fastening member and the second fastening member are releasably engageable with each other to connect the first garment portion and the second garment portion, and wherein when the first fastening member and the second fastening member are engaged with each other, the first fastening member and the second fastening member are substantially fully encased within the garment part.

According to a second aspect of the present invention, there is provided a garment which includes at least a garment part, said garment part including a first garment portion having a first fastening member, and a second garment portion having a second fastening member, wherein the first fastening member and the second fastening member are releasably engageable with each other to connect the first garment portion and the second garment portion, and wherein when the first fastening member and the second fastening member are engaged with each other, the first fastening member and the second fastening member are substantially fully encased within the garment part.

According to a third aspect of the present invention, there is provided a method of manufacturing a garment part, the method including steps of providing a first fabric layer and a second fabric layer, providing a strengthening member between the first fabric layer and the second fabric layer, attaching a fastening means to the strengthening member, and attaching the first fabric layer, the strengthening member, and the second fabric layer with one another to at least partially encase the fastening means.

According to fourth aspect of the present invention, there is provided a method of manufacturing a garment, said method including manufacturing at least one garment part, including steps of providing a first fabric layer and a second fabric layer, providing a strengthening member between the first fabric layer and the second fabric layer, attaching a fastening means to the strengthening member, and attaching the first fabric layer, the strengthening member, and the second fabric layer with one another to at least partially encase the fastening means.

DESCRIPTION OF THE PREFERRED EMBODIMENTS

Figure 1:
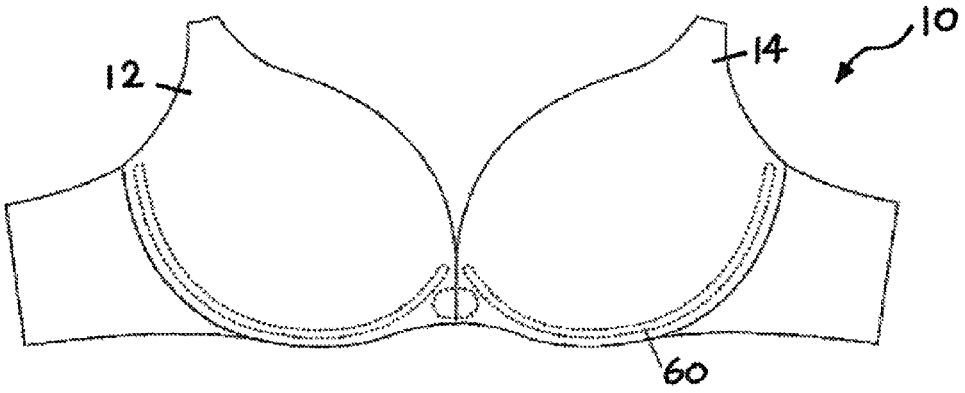
FIG. 1 is a front view of a garment part in an engaged configuration according to an embodiment of the present invention.

FIG. 1 shows a part, generally designated as 10, of a front closure bra in accordance with an embodiment of the present invention. The bra part 10 includes a first garment portion 12 and a second garment portion 14 engaged with each other by a pair of fastening members. The fastening members are releasably engageable with each other to connect the first garment portion 12 and the second garment portion 14 so that when the fastening members are engaged with each other, the fastening members are substantially fully encased within the part 10, thereby providing an easily mounted, convenient and substantially invisible closure when viewed from both the front and the back of the junction. In addition, the substantially full enclosure of the fastening members within the part 10 also allows the fastening members to be shielded from the skin of the wearer, and avoids exposing any portion of the fastening members to the wearer at both the front and the back of the junction. This prevents the fastening members from being in contact with the wearer's skin in use, and therefore minimises the discomfort caused to the wearer. The first garment portion 12 and the second garment portion 14 are arranged to cover breasts of the wearer, for example, in the form of bra cups of a bra.

Figure 2:
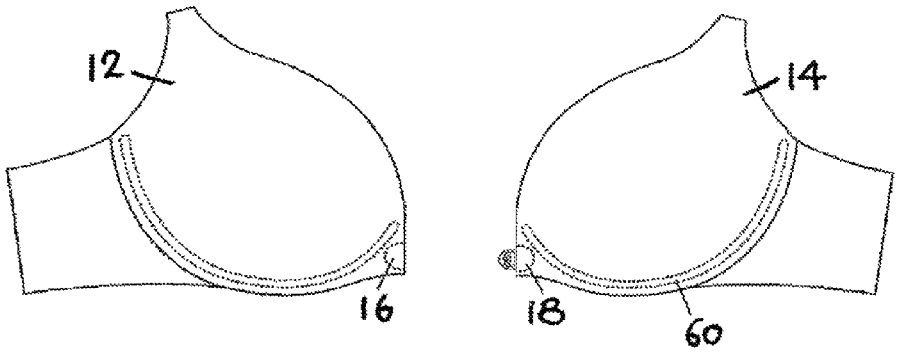
FIG. 2 is a front view of the garment part of FIG. 1 in a disengaged configuration.
Figure 3:
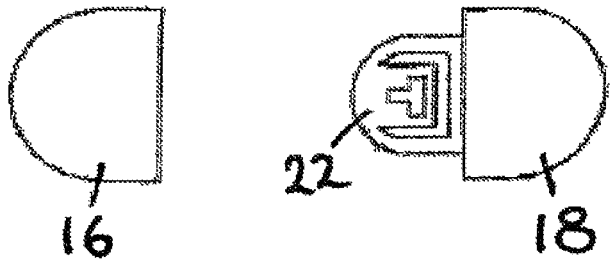
FIG. 3 is a front view of a female fastening member and a male fastening member of the garment part of FIG. 2, in which the fastening members are disengaged from each other.

FIG. 2 shows the bra part 10 of FIG. 1 with the first garment portion 12 and the second garment portion 14 in a disengaged configuration. The first garment portion 12 includes a female fastening member 16 attached thereon, and the second garment portion 14 includes a male fastening member 18 attached thereon. The first garment portion 12 and the second garment portion 14 are disengaged by having the female fastening member 16 and the male fastening member 18 disengaged from each other. It is further shown in FIGS. 3-5 that the female fastening member 16 comprises a recess 20, and the male fastening member 18 comprises a protrusion 22. The recess 20 of the female fastening member 16 is adapted to releasably receive the protrusion 22 of the male fastening member 18 to form the engagement. In another embodiment, the female fastening member 16 and the male fastening member 18 are engaged via a snap-fit coupling.

As shown in FIG. 2, the female fastening member 16 is substantially fully encased within the first garment portion 12. In the context of this invention, the female fastening member 16 as being 'substantially fully encased' should not be understood as being an entirely enclosed configuration. Instead, the first garment portion 12 includes at least an opening which provides access to the recess 20 of the female fastening member 16. The male fastening member 18 is partially encased within the second garment portion 14, having at least part of the protrusion 22 exposed from the second garment portion 14 and is capable of being received by the recess 20 of the female fastening member 16.

Figure 4:
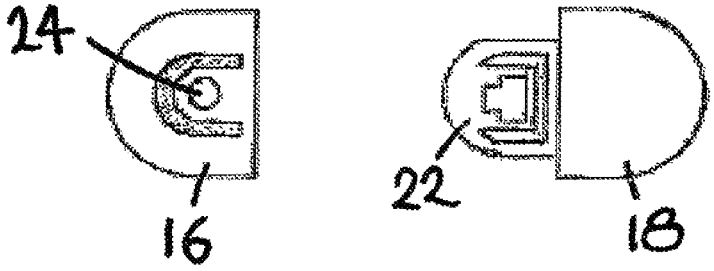
FIG. 4 is a rear view of the fastening members of FIG. 3.
Figure 5:
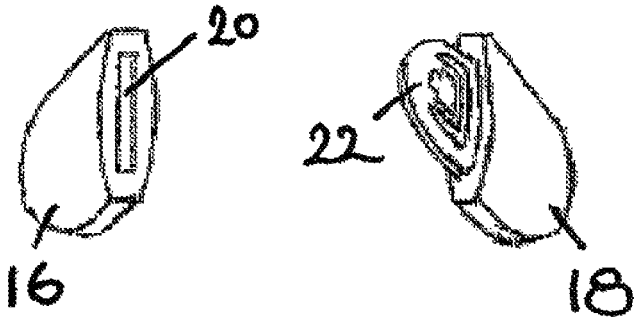
FIG. 5 is a perspective view of the fastening members of FIGS. 3 and 4.
Figure 6:
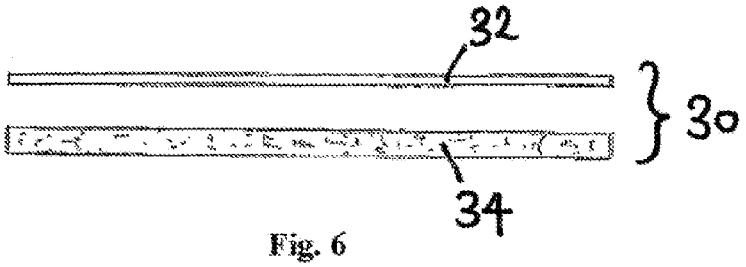
FIG. 6 is a sectional view of a fabric layer and a foam layer forming the outer layer of the first garment portion and the second garment portion of FIGS. 1 and 2.
Figure 7:
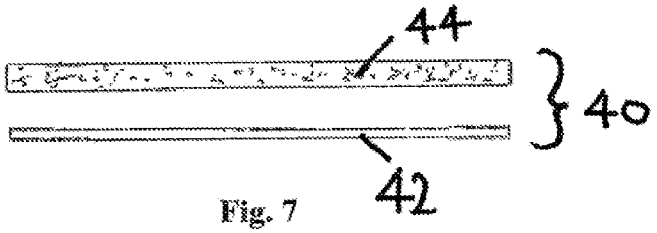
FIG. 7 is a sectional view of a foam layer and a fabric layer forming the inner layer of the first garment portion and the second garment portion of FIGS. 1 and 2.
Figure 8:
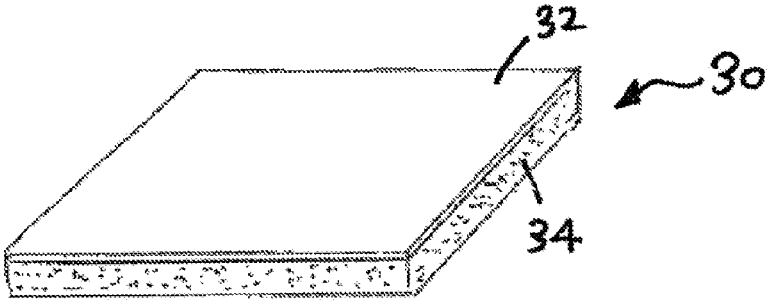
FIG. 8 is a perspective view of the outer layer having the fabric layer and the form layer shown in FIG. 6.
Figure 9:
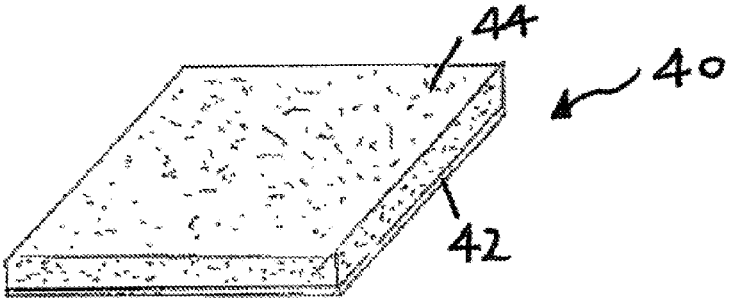
FIG. 9 is a perspective view of the inner layer having the foam layer and the fabric layer shown in FIG. 7.

FIG. 4 shows another embodiment of the female fastening member 16 which further includes a releasing means 24. When the female fastening member 16 and the male fastening member 18 are engaged with each other, the releasing means 24 is triggerable, e.g. manually, to disengage the female fastening member 16 and the male fastening member 18. The releasing means 24 can be provided in the form of a press button.

In a further embodiment of the invention, the first garment portion 12 and the second garment portion 14 each includes an outer layer 30, an inner layer 40, and a strengthening member 50 between the outer layer 30 and the inner layer 40. As shown in FIGS. 6 to 9, each of the outer layer 30 and the inner layer 40 includes a fabric layer 32, 42 attached to another fabric layer, such as a respective foam layer 34, 44. Alternatively, the fabric layer 32, 42 can be attached to any suitable materials known by a person skilled in this field, for example, a spacer fabric or a synthetic fiberfill. In one embodiment, the fabric layers 32, 42 are attached to the respective foam layers 34, 44 by an adhesive. In another embodiment, the fabric layers 32, 42 are attached to the respective foam layers 34, 44 by lamination, which may be heat lamination. In a further embodiment, the fabric layers 32, 42 are attached to the respective foam layers 34, 44 by ultrasonic adhesion. In yet a further embodiment, the fabric layers 32, 42 are attached to the respective foam layers 34, 44 by stitching. In still a further embodiment, the fabric layers 32, 42 can be attached to the respective foam layers 34, 44 by adhesion by using adhesive, heat lamination, ultrasonic adhesion, stitching or any combination thereof.

Figure 10:
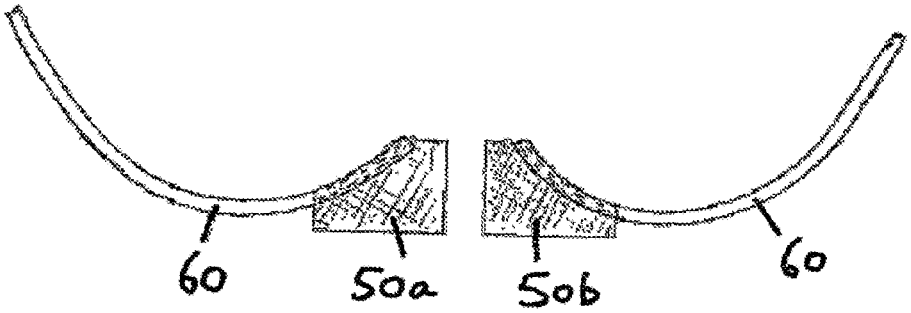
FIG. 10 is a top plan view of a pair of underwires in the garment part shown as shown in FIGS. 1 and 2, the underwires being attached to respective strengthening member according to an embodiment of the present invention.
Figure 11:
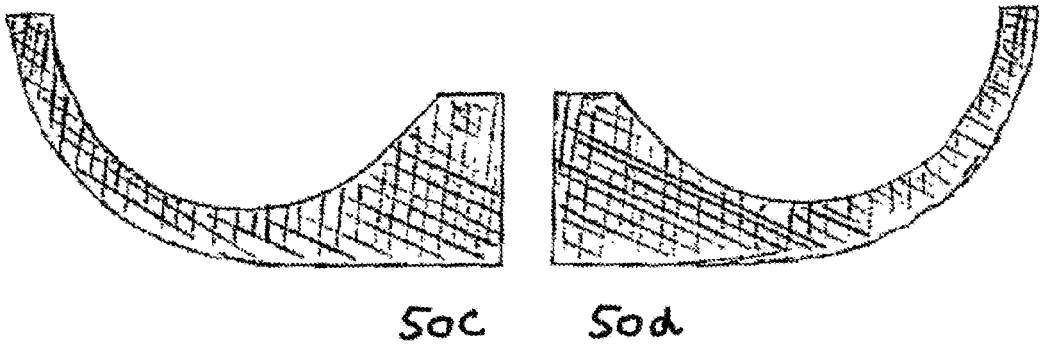
FIG. 11 is a top plan view of a pair of strengthening members for use in a garment part according to another embodiment of the present invention.

Each of the first garment portion 12 and the second garment portion 14 may optionally include at least one wire member 60 between the respective outer layer 30 and the inner layer 40 to provide additional support to the wearer's breasts. The wire member 60 can be in the form of a bare wire, a wire being partly or entirely shielded by a tubular layer such as a bra channel, or just the bra channel without any embedded wire. The bra channel can be made with any suitable materials known to a person skilled in the art such as fabric or plastic. As shown in FIG. 10, the wire members 60 can be attached to the strengthening members 50*a*, 50*b*. Alternatively, the additional support can be provided by an extended strengthening members 50*c*, 50*d* without the wire member 60, as shown in FIG. 11. Of course, such a wire member 60 is not necessary in the case of a soft cup bra.

Figure 23:
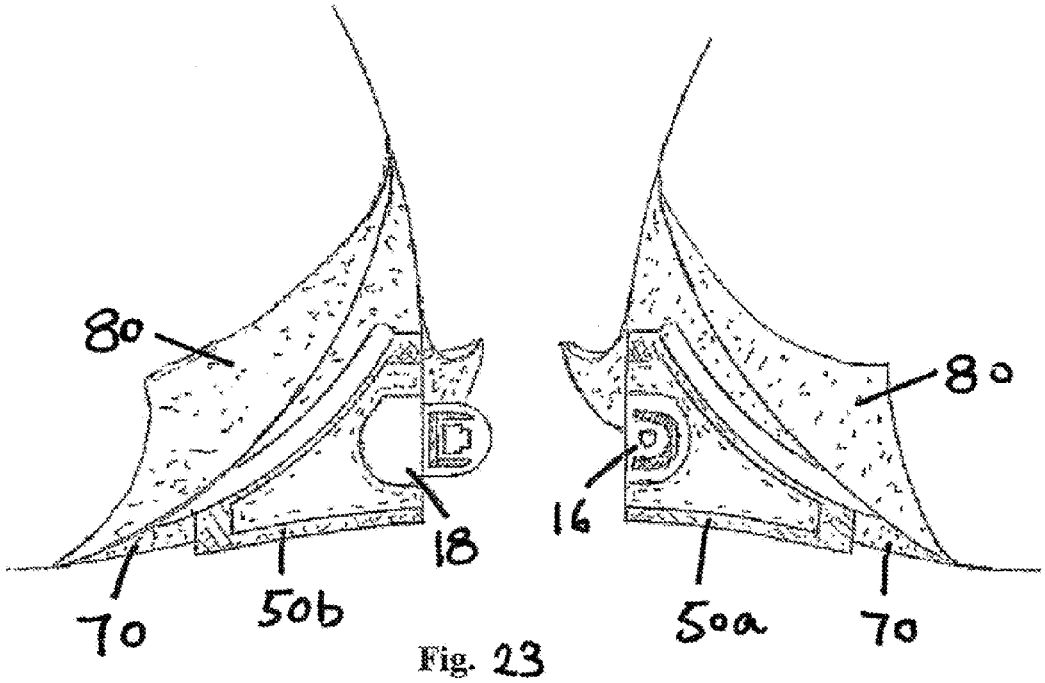
FIG. 23 is a perspective view showing attachment of the female and male fastening members to the strengthening members by stitching, in which the strengthening members are accessible at the opened bottom corers of FIG. 22.

The female fastening member 16 and the male fastening member 18 can be attached to the respective strengthening member 50*a*, 50*b* or 50*c*, 50*d*. In one embodiment, the female fastening member 16 and the male fastening member 18 are stitched on the respective strengthening members 50*a*, 50*b*, as shown in FIG. 23. The strengthening member 50 may include a substantially inelastic fabric layer which is strong enough to withstand the strain applied by the engaged fastening members when the bra is worn by a wearer. Preferably, the substantially inelastic fabric layer of the strengthening member 50 includes a material selected from a group consisting of nylon, polyester and mixtures therefore.

Further steps for manufacturing the garment part 10 of the present invention are shown in FIGS. 12-24. Such steps include providing a first layer 70 and a second layer 80 of fabric material, providing the strengthening member 50 between the first layer 70 and the second layer 80, attaching a fastening member 16 or 18 to the strengthening member 50, and attaching the first layer 70, the strengthening member 50, and the second layer 80 with one another to at least partially encase the fastening member 16 or 18. Preferably, the step of attaching is performed with heat lamination. Alternatively, the step of attaching can be performed with the use of an adhesive, for example, by introducing the adhesive between the first layer 70 and the strengthening member 50, and between the second layer 80 and the strengthening member 50. Alternatively, the step of attaching can be performed by stitching. Alternatively, the step of attaching can be performed by ultrasonic adhesion. More preferably, the step of attaching is performed by heat lamination, use of adhesive, stitching, ultrasonic adhesion or a combination thereof.

In one embodiment, the first layer 70 includes a top fabric layer 72 and a bottom foam layer 74 attached by means of adhesive and/or lamination, with the bottom foam 74 layer adjacent the strengthening member 50. The second layer 80 includes a top foam layer 84 and a bottom fabric layer 82 attached by means of adhesive and/or lamination, with the top foam layer 84 adjacent the strengthening member 50.

Figure 12:
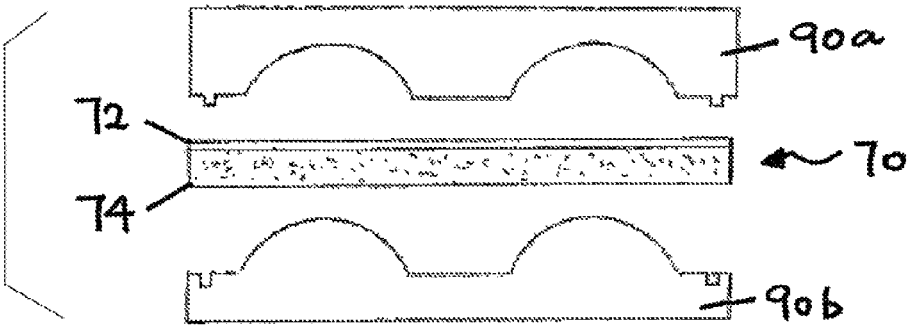
FIG. 12 is a sectional view of a molding device having a female mold and a corresponding male mold for manufacturing the garment part as shown in FIGS. 1 and 2, with the outer layer of the garment portion of FIGS. 6 and 8 placed between them.
Figure 13:
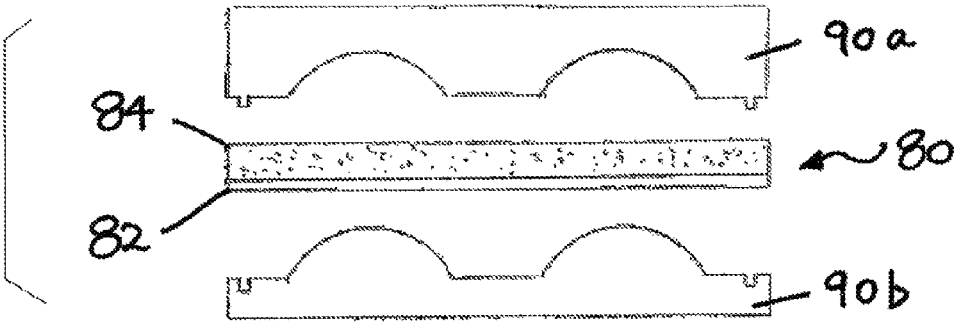
FIG. 13 is a sectional view of a molding device of FIG. 12 having the inner layer of the garment portion of FIGS. 7 and 9 placed between them.
Figure 14:
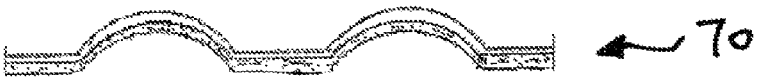
FIG. 14 is a sectional view of the outer layer after being released from the molding device of FIG. 12.
Figure 15:
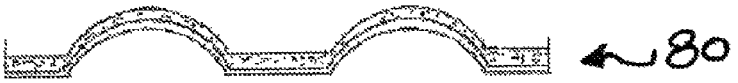
FIG. 15 is a sectional view of the inner layer after being released from the molding device of FIG. 13.

As shown in FIGS. 12 and 14, the first layer 70 is premolded into a concave shape by a molding device 90*a*, 90*b*, with the bottom foam layer 74 of the first layer 70 defining a concavity of the concave shape. Also as shown in FIGS. 13 and 15, the second layer 80 is also premolded into a concave shape by the molding device 90*a*, 90*b*, with the bottom fabric layer 82 of the second layer 80 defining a concavity of the concave shape. The concavities of the first layer 70 and the second layer 80 accommodate the shape of the breasts of the wearer thereby allowing the garment part to serve as bra cups for covering and supporting breasts of the wearer. The molding device 90 can be any suitable molding tools conventionally used in the field, and a person skilled in the art would understand that it should not be limited to a particular molding device, but can be any molding tools suitable in performing the purpose.

Figure 16:
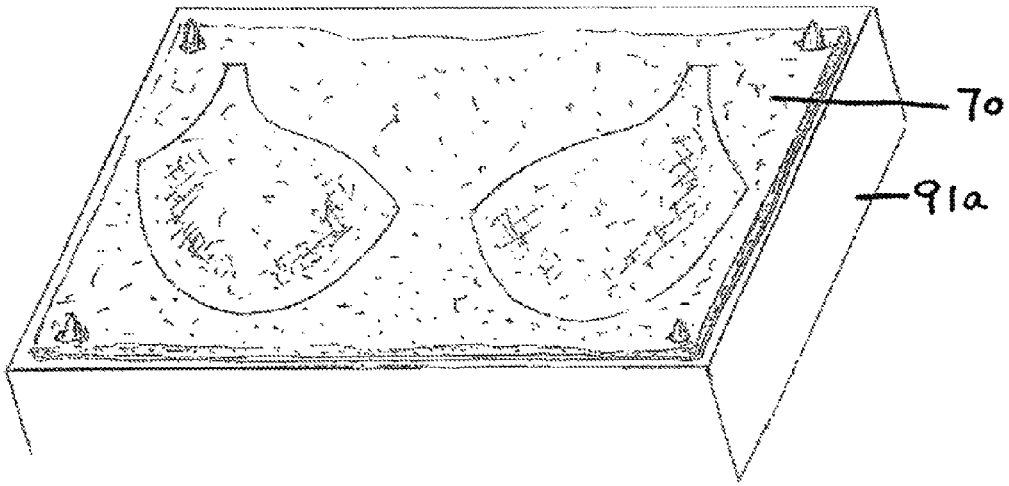
FIG. 16 is a perspective view showing a step of lamination according to an embodiment of the present invention, with the premolded outer layer of FIG. 14 positioned on the female mold.
Figure 17:
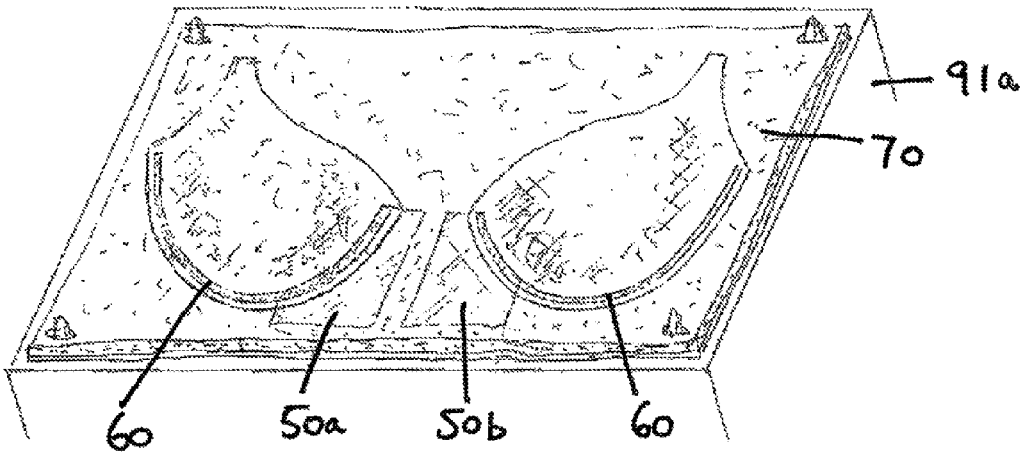
FIG. 17 is a perspective view showing a step of lamination following the step of FIG. 16, with the underwires and the strengthening members positioned on the premolded outer layer.
Figure 18:
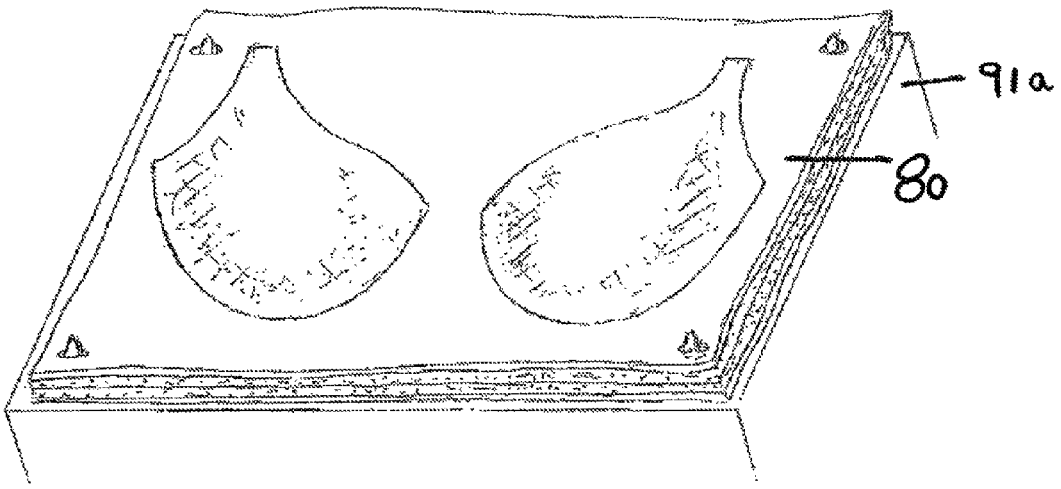
FIG. 18 is a perspective view showing a step of lamination following the step of FIG. 17, with the premolded inner layer of FIG. 15 positioned above the underwires and the strengthening members.
Figure 19:
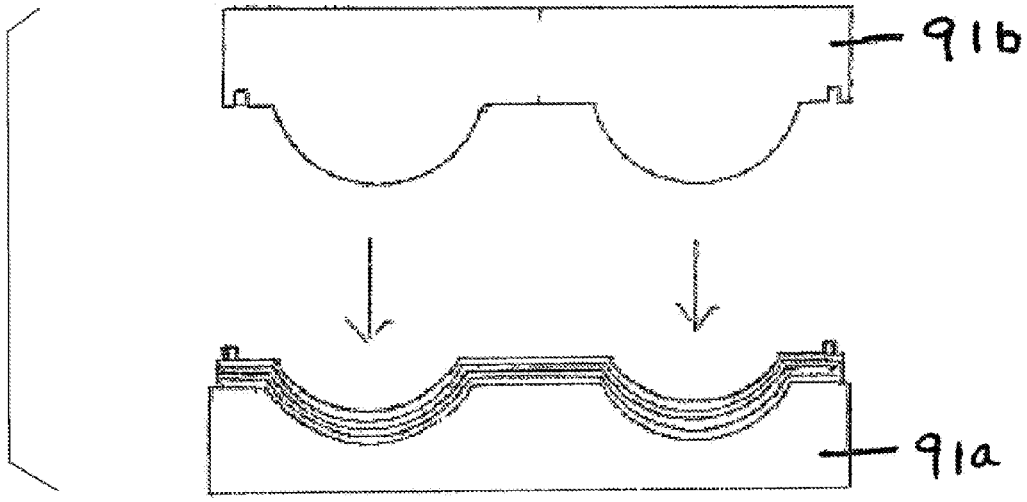
FIG. 19 is a sectional view of the molding device with the male and the female molds being separated, with the premolded inner layer, outer layer and the strengthening members of FIG. 18 positioned between them.
Figure 20:
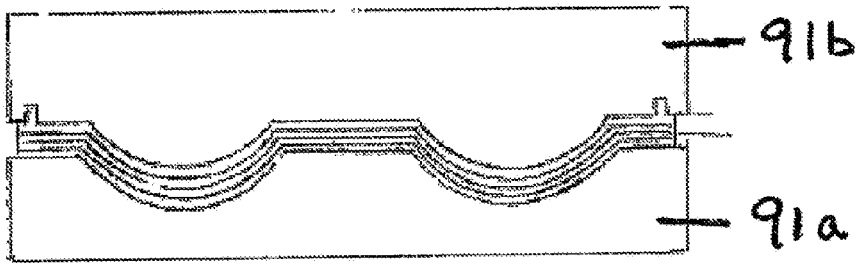
FIG. 20 is a sectional view of the molding device of FIG. 19, with the male and the female molds closed to compress the layers therebetween.
Figure 21:
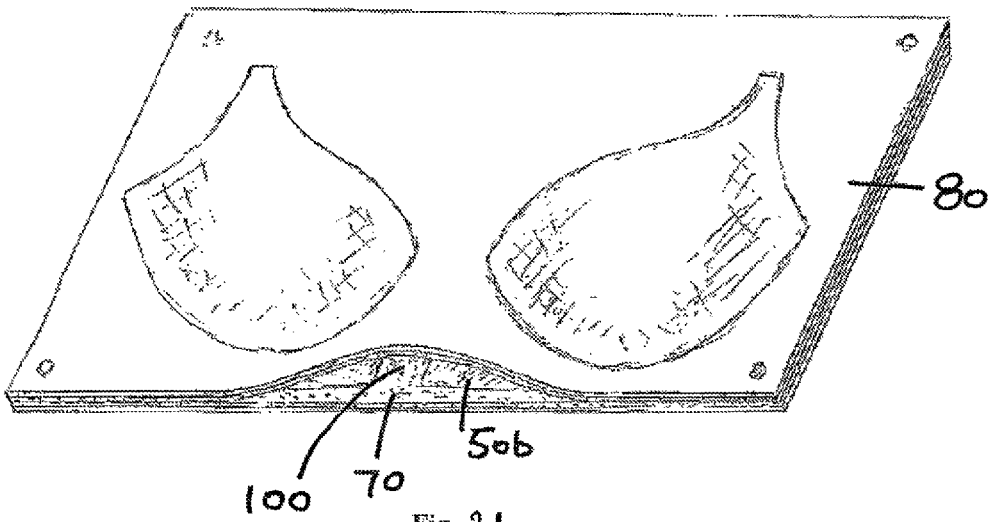
FIG. 21 is a perspective view of the laminated layers after being released from the molding device of FIG. 20, the laminated layers including an opening at the bottom edge of the laminated layers.
Figure 22:
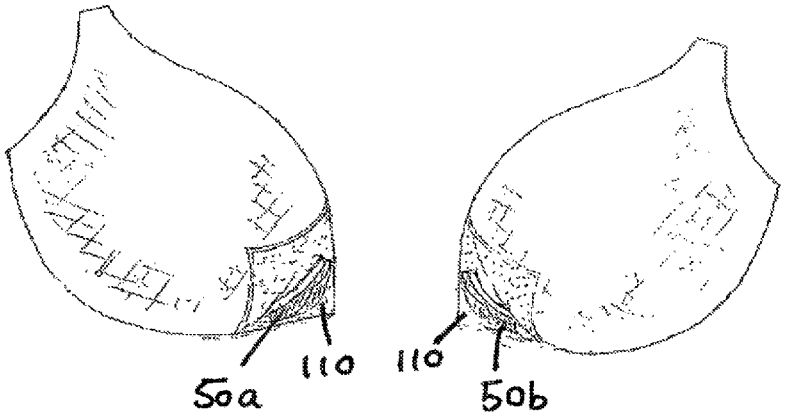
FIG. 22 is a perspective view of the garment parts after being cut out from the laminated layers of FIG. 21, the garment parts each having an opened bottom corner.

The step of providing the first layer 70 and the second layer 80 further includes a step of positioning the premolded first layer 70 onto a female mold 91*a* of the molding device 91 as shown in FIG. 16. Preferably, prior to providing the strengthening member, the manufacturing steps further include a step of providing a wire member 60 on the first layer 70, followed by a step of attaching the strengthening member 50 to the wire member 60 as shown in FIG. 17. The premolded second layer 80 is then positioned on the wire member 60 and the strengthening member 50 prior to the laminating step as shown in FIG. 18. As shown in FIGS. 19 and 20, the laminating step includes the step of positioning a male mold 91*b* of the molding device 91 onto the female mold 91*a* and subsequently applying pressure to compress the layers in between. It is important that a portion of the bottom edge should be left unsealed to provide an opening 100 as shown in FIG. 21. After releasing the laminated layers from the molding device 91, the laminated layers are cut to the required size and shape to form garment parts 10. The opening 100 provides each of the garment parts with an at least partially opened bottom corner 110, which allows the access of the strengthening member for any further processing. For example, as shown in FIG. 23, either the first layer 70 or the second layer 80 at the opened bottom corner 110 can be turned over to expose the intermediate strengthening members 50*a*, 50*b* so that the fastening members 16, 18 can be attached to the respective strengthening member 50, such as, by stitching, ultrasonic adhesion, heat lamination, adhesion or a combination thereof.

Figure 24:
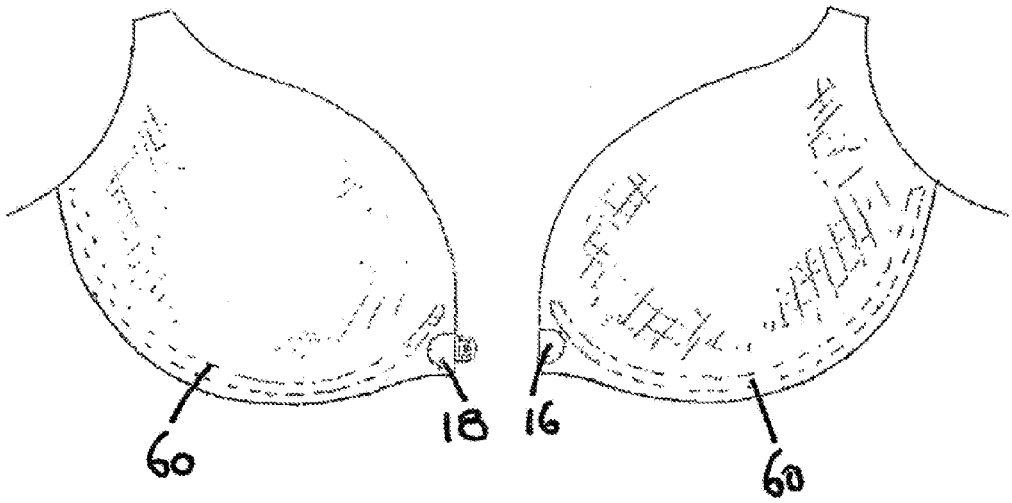
FIG. 24 is a front view of the garment parts of FIG. 23 with the opened bottom corners closed.
Figure 25:
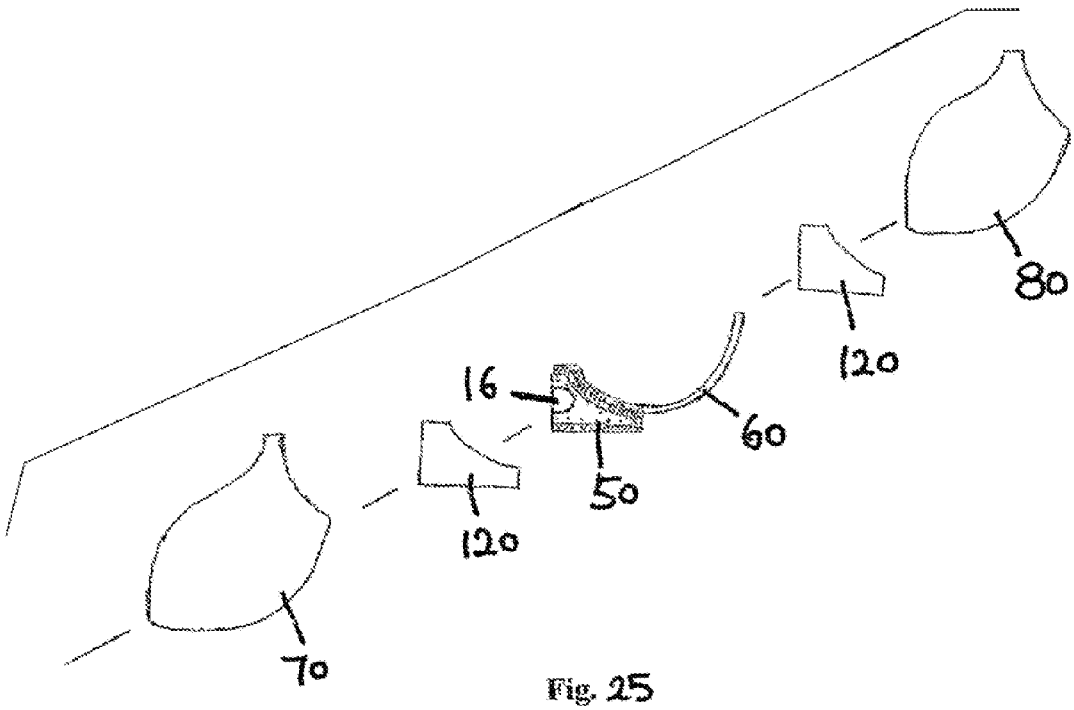
FIG. 25 is an exploded view showing the layers composing the garment part of FIG. 24.

FIG. 24 further shows the garment parts 10 when the opened bottom corners 110 are closed, for example, by stitching, and/or an adhesive and/or lamination. FIG. 25 is an exploded view showing the composing layers of the garment part 10 in sequence, starting from the first layer 70, the adhesive 120, the strengthening member 50 connected with the wire member 60 and the fastening member 16, another adhesive 120, and the second layer 80.

The bra part 10 as shown in FIG. 25 can be further processed by forming or joining further fabric materials or parts to the bra part 10 to form a bra. For example, shoulder straps and back fabric portions can be connected to the bra part 10 by means of stitching or other engagement means to form a bra.

It should be understood that the above only illustrates and describes examples whereby the present invention may be carried out and serve, for example, as a garment part of a bra, and that modifications and/or alterations may be made thereto without departing from the spirit of the invention. For example, while the specific embodiments are related to front closure bras, a person skilled in the art would understand that the invention could also be used for a rear fastening system of a rear closure bra, or for closure system at any suitable position of the bra. The invention could also be used as a part with fastening system for any undergarments or garments, for example, corsets or swimsuits.

It should also be understood that certain features of the invention, which are, for clarity, described in the context of separate embodiments, may also be provided in combination in a single embodiment. Conversely, various features of the invention which are, for brevity, described in the context of a single embodiment, may also be provided or separately or in any suitable subcombination.

The invention claimed is:

1. A garment part including:

a first garment portion having a first fastening member, and a second garment portion having a second fastening member, wherein the first fastening member and the second fastening member are releasably engageable with each other to connect the first garment portion and the second garment portion, wherein when the first fastening member and the second fastening member are engaged with each other, the first fastening member and the second fastening member are fully encased within the garment part, and a part of the second fastening member is encased within the first garment portion, wherein the first fastening member is attached to the first garment portion and the second fastening member is attached to the second garment portion, wherein each of the first garment portion and the second garment portion includes an outer layer, an inner layer, and a strengthening member between the outer layer and the inner layer, wherein the first fastening member and the second fastening member are attached to the respective strengthening member, and wherein each of the first garment portion and the second garment portion includes at least one wire member between the respective outer layer and the inner layer, the wire member being attached to the respective strengthening member.

2. The garment part according to claim 1, wherein the first fastening member and the second fastening member are releasably engageable with each other via a snap-fit coupling.

3. The garment part according to claim 2, wherein the first fastening member includes a recess and the second fastening member includes a protrusion, the recess of the first fastening member being adapted to releasably receive the protrusion of the second fastening member to form the snap-fit coupling.

4. The garment part according to claim 1, wherein the first fastening member is encased within the first garment portion, except an opening of a recess of the first fastening member being exposed to allow reception of a part of the second fastening member into the recess, and wherein the second fastening member is at least partially encased within the second garment portion.

5. The garment part according to claim 1, wherein at least one of the first fastening member and the second fastening member includes a releasing mechanism which, when the first fastening member and the second fastening member are engaged with each other, is triggerable to disengage the first fastening member from the second fastening member.

6. The garment part according to claim 1, wherein the first fastening member and the second fastening member are attached to the respective strengthening member by stitching, heat lamination, adhesion, ultrasonic adhesion or a combination thereof.

7. The garment part according to claim 1, wherein the strengthening member includes an inelastic fabric layer.

8. The garment part according to claim 7, wherein the inelastic fabric layer is made of a material selected from a group consisting of nylon, polyester and mixtures thereof.

9. A garment part including:

a first garment portion having a first fastening member, and a second garment portion having a second fastening member, wherein the first fastening member and the second fastening member are releasably engageable with each other to connect the first garment portion and the second garment portion, wherein when the first fastening member and the second fastening member are engaged with each other, the first fastening member and the second fastening member are fully encased within the garment part, and a part of the second fastening member is encased within the first garment portion, wherein the first fastening member is attached to the first garment portion and the second fastening member is attached to the second garment portion, wherein each of the first garment portion and the second garment portion includes an outer layer, an inner layer, and a strengthening member between the outer layer and the inner layer, wherein the first fastening member and the second fastening member are attached to the respective strengthening member, and wherein at least one of the outer layer and the inner layer includes a fabric layer attached to a foam layer.

10. The garment part according to claim 9, wherein the fabric layer and the foam layer are attached with each other by stitching, heat lamination, adhesion or a combination thereof.

11. A garment including at least a garment part, said garment part including:

a first garment portion having a first fastening member, and a second garment portion having a second fastening member, wherein the first fastening member and the second fastening member are releasably engageable with each other to connect the first garment portion and the second garment portion, wherein when the first fastening member and the second fastening member are engaged with each other, the first fastening member and the second fastening member are fully encased within the garment part, and a part of the second fastening member is encased within the first garment portion, and wherein said garment is a brassiere.

12. The garment according to claim 11, wherein the first garment portion and the second garment portion of the garment part each includes a bra cup of the brassiere.

13. A method of manufacturing a garment part, the method comprising the steps of:

providing a first fabric layer and a second fabric layer, providing strengthening means between the first fabric layer and the second fabric layer, attaching a fastening mechanism to the strengthening means, and attaching the first fabric layer, the strengthening means, and the second fabric layer with one another to encase the fastening mechanism such that only an opening of a recess of the fastening mechanism is exposed to the outside environment, wherein the second fabric layer includes a top foam layer and a bottom fabric layer, the top foam layer being adjacent the strengthening means, and wherein the second fabric layer is premolded into a concave shape, with the bottom fabric layer of the second fabric layer defining a concavity of the concave shape.

14. The method according to claim 13, wherein the first fabric layer includes a top fabric layer and a bottom foam layer, the bottom foam layer being adjacent the strengthening means.

15. The method according to claim 13, further comprising a step of providing a wire member between the first fabric layer and the second fabric layer prior to the step of providing the strengthening means.

16. The method according to claim 15, further comprising a step of attaching the strengthening means to the wire member.

17. The method according to claim 14, wherein the first fabric layer is premolded into a concave shape, with the bottom foam layer of the first fabric layer defining a concavity of the concave shape.

18. The method according to claim 13, wherein the step of attaching the first fabric layer, the strengthening means, and the second fabric layer with one another to at least partially encase the fastening mechanism is performed by stitching, heat lamination, adhesion or a combination thereof.

19. The method according to claim 18, wherein, when said step of attaching the first fabric layer, the strengthening means and the second fabric layer with one another to at least partially encase the fastening mechanism is performed by adhesion, the adhesion is performed by using an adhesive.

20. The method according to claim 19, further including a step of introducing the adhesive between the first fabric layer and the strengthening means, and between the second fabric layer and the strengthening means.

21. The method according to claim 13, wherein the step of attaching the fastening mechanism to the strengthening means is performed by stitching, heat lamination, adhesion, ultrasonic adhesion or a combination thereof.

22. A method of manufacturing a garment, including the steps of:

manufacturing at least one garment part by a method including the steps of providing a first fabric layer and a second fabric layer, providing strengthening means between the first fabric layer and the second fabric layer, attaching a fastening mechanism to the strengthening member, and attaching the first fabric layer, the strengthening means, and the second fabric layer with one another to encase the fastening mechanism such that only an opening of a recess of the fastening mechanism is exposed to the outside environment, forming at least one further part, and joining the at least one further part to the at least one garment part to form the garment, wherein the garment is a brassiere.

23. A garment part including:

a first garment portion having a first fastening member, and a second garment portion having a second fastening member, wherein the first fastening member and the second fastening member are releasably engageable with each other to connect the first garment portion and the second garment portion, wherein when the first fastening member and the second fastening member are engaged with each other, the first fastening member and the second fastening member are fully encased within the garment part, and a part of the second fastening member is encased within the first garment portion, and wherein the first garment portion and the second garment portion are bra cups.

24. The garment part according to claim 23, wherein the first fastening member and the second fastening member are releasably engageable with each other to connect the first garment portion and the second garment portion at a front part of the garment part.

* * * * *